US005564977A

United States Patent [19]

Algie

[11] Patent Number: 5,564,977

[45] Date of Patent: Oct. 15, 1996

[54] INTEGRATED RACETRACK DISPLAY SYSTEM INCLUDING DISPLAY OF PERIODIC PARIMUTUEL DATA

[75] Inventor: Robert Algie, Allandale, Australia

[73] Assignee: Trans-Lux Corporation, Norwalk, Conn.

[21] Appl. No.: 295,983

[22] Filed: Aug. 25, 1994

[51] Int. Cl.[6] ..... G06G 7/48

[52] U.S. Cl. ..... 463/25; 463/30; 463/40; 463/41; 463/42

[58] Field of Search ..... 273/138 R, 433, 273/434, 439, 138 A, 139, 274; 370/77; 364/412, 411; 340/323 R; 463/25, 30, 40–42

[56] References Cited

U.S. PATENT DOCUMENTS

| | | | |
|---|---|---|---|
| 2,081,822 | 5/1937 | Kimbell | 340/323 R |
| 3,124,674 | 3/1964 | Edwards et al. | 364/412 |
| 3,327,292 | 6/1967 | Eriksson et al. . | |
| 3,505,646 | 4/1970 | Affel, Jr. et al. | 364/412 |
| 3,513,440 | 5/1970 | Wells | 340/323 R |
| 3,594,762 | 7/1971 | Gardberg et al. | 340/323 R |
| 3,697,698 | 10/1972 | Oswald et al. . | |
| 3,810,627 | 5/1974 | Levy | 273/138 A |
| 4,032,946 | 6/1977 | Wakatsuki et al. | 364/412 |
| 4,951,039 | 8/1990 | Schwendeman et al. | 273/86 R |
| 5,212,636 | 5/1993 | Nakazawa | 364/412 |
| 5,275,400 | 1/1994 | Weingardt et al. | 273/274 |
| 5,411,258 | 5/1995 | Wilson et al. | 364/412 |
| 5,476,259 | 12/1995 | Weingardt | 273/138 A |

FOREIGN PATENT DOCUMENTS

| | | | |
|---|---|---|---|
| 2028554 | 3/1980 | United Kingdom | 273/138 A |
| 2229565 | 9/1990 | United Kingdom | 273/138 A |

OTHER PUBLICATIONS

IEEE Spectrum, Jul. 1994, "Higher Visibility for LEDs" picture, p. 33.

*Primary Examiner*—Jessica Harrison
*Assistant Examiner*—Mark A. Sager
*Attorney, Agent, or Firm*—Kane, Dalsimer, Sullivan, Kurucz, Levy, Eisele and Richard, LLP

[57] ABSTRACT

The apparatus relates to a display apparatus for a betting parlor associated with a racetrack or Totalizator company, including a display of a large amount of racing and parimutuel data, particularly periodic parimutuel or odds data and the history thereof. Subsequent display portions display fluctuating odds then successively lock as the start of the race approaches.

14 Claims, 6 Drawing Sheets

INTEGRATED RACETRACK DISPLAY SYSTEM INCLUDING DISPLAY OF PERIODIC PARIMUTUEL DATA

BACKGROUND OF THE INVENTION

1. Field of the Invention

The invention relates to a display apparatus for a racetrack or for a betting parlor associated with a racetrack or Totalizator company, including a display of a large amount of racing and parimutuel data, particularly periodic parimutuel or odds data and the history thereof.

2. Description of the Prior Art

In the prior art, it is well known to display racing and parimutuel data at a racetrack, betting parlor or similar location to enable, indeed encourage, the racing enthusiast to place bets on the racing results.

In its pure form, parimutuel betting allows those holding winning tickets to divide the total amount bet, less a house percentage, in proportion to their wagers. This guarantees a specific return to the racetrack, but also results in fluctuating odds (or "totalizator dividends" in Australian parlance) for a given bet as the start of the race approaches and the proportion of the amount placed on a given bet as a percentage of the total amount bet (i.e., all bets) changes. This can be disconcerting to some bettors (or "punters" in Australian parlance) as a bettor (or "punter") can place a bet at given odds only to see these odds be reduced as the race approaches. This can result in bettors ("punters") delaying placing a bet until immediately before the race in order to gain at least some certainty as to the potential payback of the bet. This can result in lost opportunities to place a bet if many bettors ("punters") wait until the last minute and try to rush to the betting window immediately prior to the race. This can result in fewer bets and a lower total amount wagered from which the racing facility receives a percentage. This can also result in a greater instability in the odds finally offered in a parimutuel system.

Moreover, the more information given to a bettor ("punter"), the more likely the bettor is to place a bet or to devise a systematic method for predicting the winner of a race using the new information (i.e., "work out a system") and confidently place even more bets. Under a parimutuel system, whether or not such a method results in a long-term advantage to an individual bettor ("punter"), within limits, is usually inconsequential to the racing facility as it receives a given percentage of the total amount bet. More simply, the more excited the bettors become about betting, the more money the racing facility makes, and any apparatus or method for exciting the bettors is usually profitable for the racing facility.

OBJECTS AND SUMMARY OF THE INVENTION

It is therefore an object of this invention to provide a large amount of information in a pleasing and systematic way to bettors ("punters") at a racetrack, betting parlor or similar facility associated with a racetrack in order to excite the bettors into placing bets.

It is therefore a further object of this invention to provide information to bettors ("punters") at a racetrack, betting parlor or similar facility in order to encourage the bettors to devise systematic methods for betting and therefore place more bets.

It is therefore a still further object of this invention to provide information to bettors ("punters") at a racetrack, betting parlor or similar facility to show the history or trends in the odds given to a particular bet in order to encourage the bettor ("punter") to place a bet, particularly at a time other than the last minute before the start of a race, thereby perhaps reducing some of the instability in the odds finally offered by a parimutuel system. Additionally, this ability to watch the history or trends in the odds of a particular bet combines the excitement of a video game, a securities ticker-tape (or "Quotron") and a racetrack, and can excite the bettor who thrives on "action" and encourage the bettor ("punter") to place more bets.

These and other objects are achieved by a system with a centralized processing unit and several large-scale displays including a display which displays the current fluctuating odds offered for a particular bet, along with the corresponding odds offered at given times or time intervals prior to the race, thereby allowing the bettor to see the history or trends of the parimutuel data associated with that particular bet.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
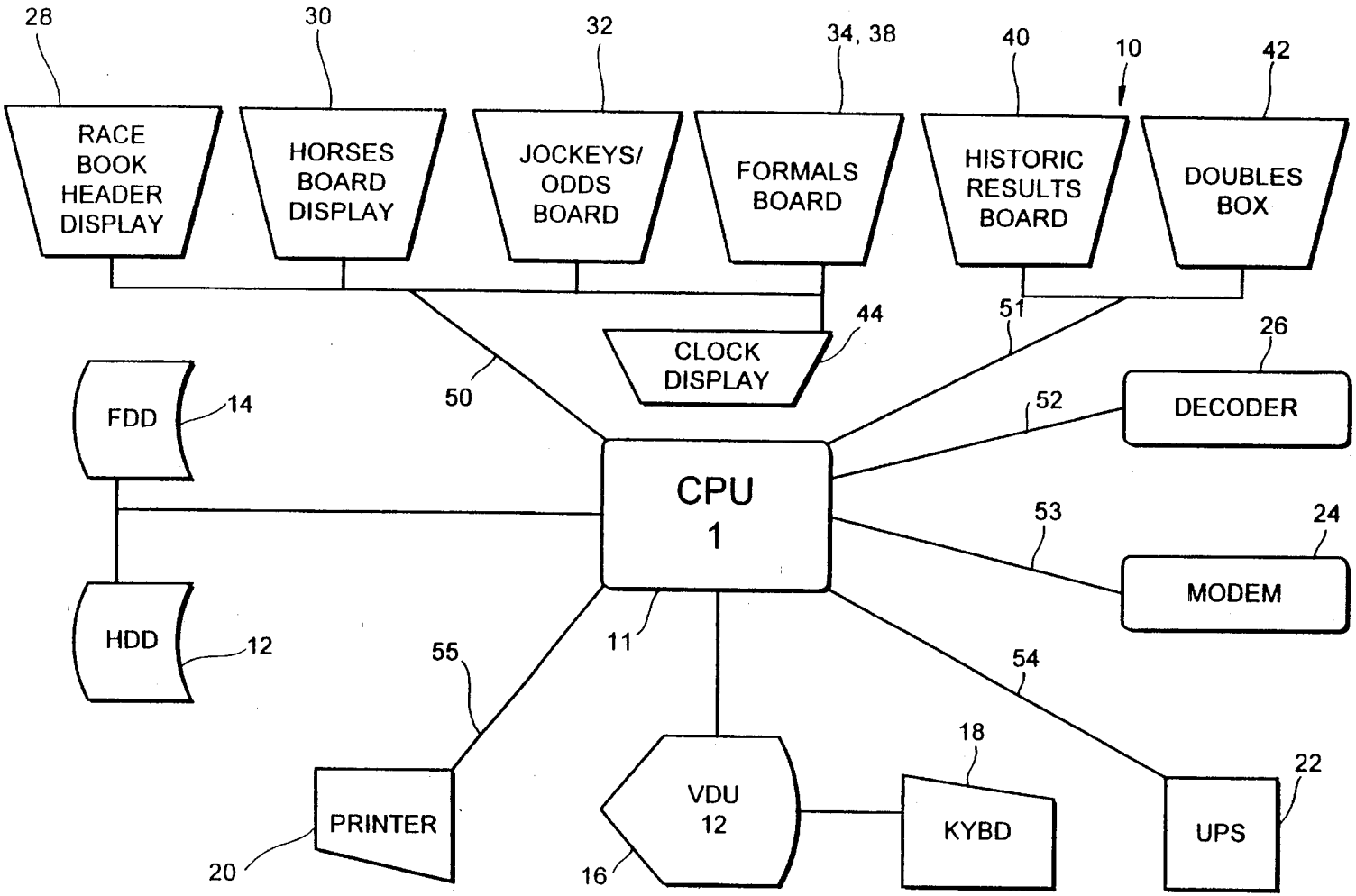
FIG. 1 is a block diagram schematic of the hardware of the present invention.

Referring now to the drawings in detail wherein like numerals indicate like elements throughout the several views, one sees that FIG. 1 is a block diagram schematic of the hardware of the integrated display system 10.

The heart of the integrated display system 10 is central processing unit (CPU) 11. Presently, the minimum recommended hardware requirements for the CPU 11 are a 486DX processor, 4 megabytes of random access memory (RAM), 5 RS232 serial ports 50–54, one parallel port 55 and a 200 watt power supply in an IBM-AT or equivalent clone configuration. The CPU 11 typically loads programs from the hard disk drive 12 or floppy disk drive 14 into RAM for execution. These programs include an operating system, display application programs, and a program to organize the parimutuel data as received from a racetrack (alternately, for on-site racetrack locations, a program will be included to calculate the various odds periodically prior to a race). CPU 11 further should include a system clock to trigger the program module responsible for the separation of data for processing to the various display boards. Of course, some variations from a pure parimutuel system are envisioned. Similarly, variations and upgrades in storage devices due to technological advances are envisioned.

Video display terminal 16, typically a color VGA screen, keyboard 18, typically a standard 101-key keyboard, and printer 20 (via parallel port 55) communicate with CPU 11 in a conventional manner. Similarly, CPU 11 is provided with an uninterruptable power supply (UPS) 22 which senses a power outage or other transient via serial port 54.

Additionally, for applications off-site from the racetrack, CPU 11 communicates with modem 24 via serial port 53 and decoder 26 via serial port 52. Modem 24 typically must be capable of communicating over standard phone lines at 9600 baud. Modem 24 is used to download all race details at the start of the day and as an avenue to log-on to the system from a remote site for troubleshooting purposes. This also allows the upgrading of software via the telephone lines. Presently, a "Netcomm SmartModem V.32 bis E7" is recommended for this application. Of course, numerous technically equivalent substitutions are available. Alternately, for applications on-site with the racetrack, CPU 11 communicates with the central parimutuel computer system via serial port 53 either directly or through modem 24.

Decoder 26 is an interface between the broadcast data and the CPU 11. The broadcast data typically originates at the facility where the race is taking place, is encoded, and is transmitted to remote betting parlors (e.g., off-track betting parlors) where the data is decoded by decoder 26 and fed to CPU 11. Decoder 26 typically communicates with CPU 11 using RS232 ASCII protocol via serial port 52. In Australia, the information is carried on a sideband of Channel 7 and its regional network stations.

Figure 2:
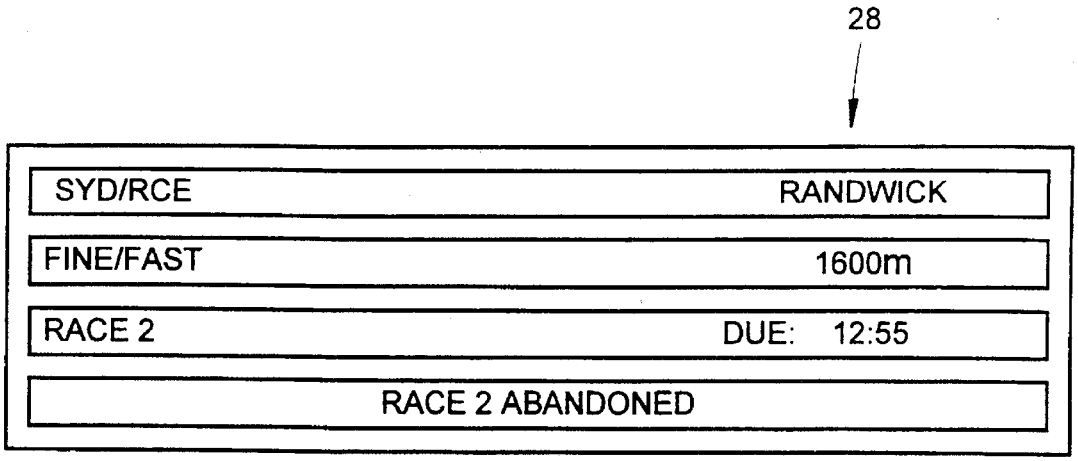
FIG. 2 is an example of the race book header display board of the present invention.

Header display board 28 is driven by CPU 11. Header display board 28 is typically a "DataWall" Display Panel as manufactured by the assignee of the present application (an application using CRT screens will be described hereinafter). A typical header display board 28 would be 24 characters wide, four lines deep and made of 2.1 inch character blocks comprised of light-emitting diodes (LEDs). As shown in FIG. 2, the top line of header display board 28 typically displays the race code and track location. The second line displays the weather, the track rating, and the track distance. The third line displays the race number and the current race start time. The fourth line is used to display relevant messages (e.g., that the race has been cancelled).

Figure 3:
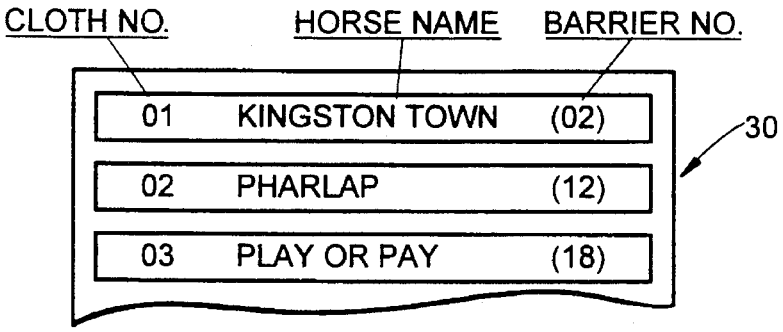
FIG. 3 is an example of the horses board section display board of the present invention.

Horses display board 30 is driven by CPU 11. Horses display board 30 is typically a "DataWall" Display Panel as manufactured by the assignee of the present application. A typical horses display board 30 would be 24 characters wide, 24 lines deep and made of 1.2 inch character blocks comprised of light-emitting diodes (LEDs). As shown in FIG. 3, horses display board 30 typically displays the saddle cloth number, the horse's name, and the gate number (i e., "start barrier number" in Australian parlance) drawn for each horse. The data displayed on horses display board 30 typically does not change prior to a race. However, one update to the horses display board 30 may be if a horse enters the line-up late. Of course, this configuration is applicable to racing animals other than horses, such as greyhounds.

Figure 4:
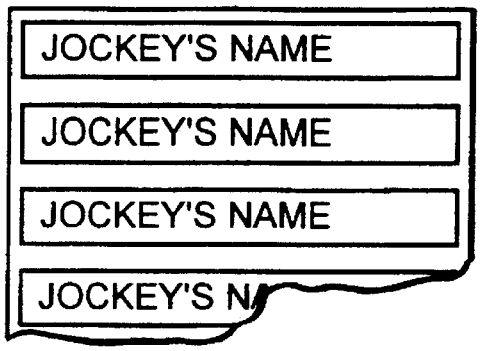
FIG. 4 is an example of the jockeys/odds display board of the present invention, in a first mode displaying the jockeys' names.
Figure 5:
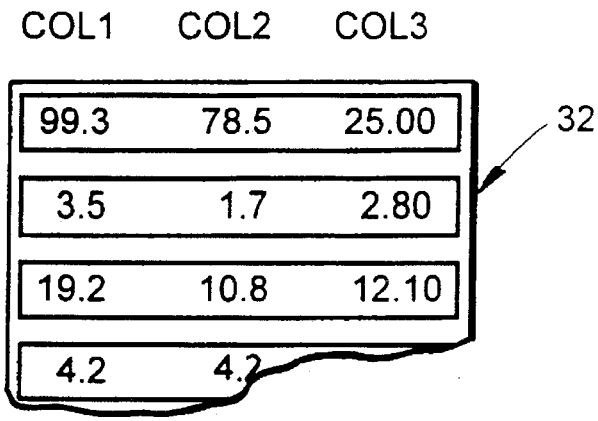
FIG. 5 is an example of the jockeys/odds display board of the present invention, in a second mode displaying the fluctuating odds offered, in other words displaying periodic parimutuel data.

Jockeys/odds display board 32 is driven by CPU 11 and can display in one of two modes—jockeys mode or odds mode as shown in FIGS. 4 and 5, respectively. Jockeys/odds display board 32 is typically a "DataWall" Display Panel as manufactured by the assignee of the present application. A typical jockeys/odds display board 32 would be 16 characters wide, 24 lines deep and made of 1.2 inch character blocks comprised of light-emitting diodes (LEDs).

The jockeys/odds display board 32 is the most dynamic of all of the display boards in display system 10 and is calculated to produce the most excitement at the betting facility. As shown in FIG. 4, when the race to be displayed is first transmitted to the display system 10, jockeys/odds display board 32 displays the names of all of the jockeys that are assigned to the relevant mounts. If a mount does not have a jockey assigned at the time of display, it is shown as "NOT DECLARED". The jockeys/odds display board 32 displays the jockeys' names until the odds are due for display.

The timing of the display of the odds (i.e., the second mode of the jockeys/odds display board 32 as shown in FIG. 5) is controlled by two factors, one being the race type and the second being the time between races. For instance, in Australia, in thoroughbred racing, races are typically run every thirty minutes (weekdays) to forty minutes (weekends); in harness racing, races are typically run every twenty to thirty minutes; and in greyhound dog racing, races are typically run every fifteen to twenty minutes. This requires that the jockey/odds display board 32 display odds at varying rates for the different race types.

The odds columns are typically displayed in the following time segments before race start time:

| Race Type | Col. 1 | Col. 2 | Col. 3 |
|---|---|---|---|
| Thoroughbred Racing | 20 min. | 10 min. | 5 min. |
| Harness Racing | 18 min. | 10 min. | 5 min. |
| Greyhound Racing | 14 min. | 7 min. | 4 min. |

The odds are displayed in the following manner. At a predetermined time prior to the scheduled start of a race, the CPU 11 receives the current parimutuel data from the data stream received via the decoder 26, extracts the current odds and displays the odds data on jockeys/odds display board 32. It firstly removes the display of the jockeys' names from the jockeys/odds display board 32, then the first column of odds (see "Col. 1" above) is displayed. This first column is dynamically updated as data is received. The odds displayed in the first column will fluctuate until the time prior to the race for the second column (see "Col. 2" above) is reached. The odds display in the first column is locked (that is, the odds at the time prior to the race for the first column is continuously displayed) and the second column then starts to display the fluctuating odds until the time prior to the race as display for the third column (see "Col. 3" above) is reached. The odds display in the second column is then locked and the third column then starts to display the fluctuating odds until the start of the race. After the race has started, the decoder 26 receives collated data with final pools and odds which are then displayed and the header display board 28 is updated to read "FINAL ODDS" where the race start time is otherwise displayed. The final odds are typically displayed for two minutes after the race has finished, so that the bettors ("punters") can see what, if anything, they will be paid. The integrated display system 10 then displays the next race and the cycle starts again.

Figure 6:
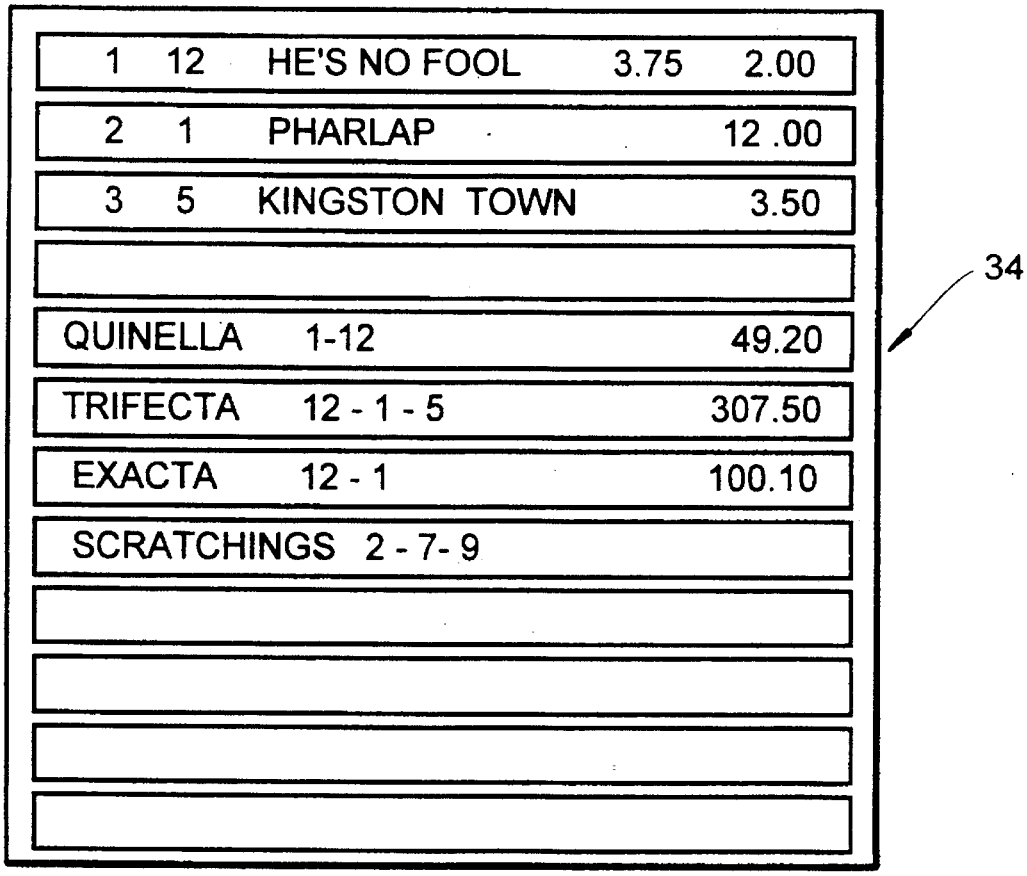
FIG. 6 is an example of the large formals display board of the present invention.
Figure 7:
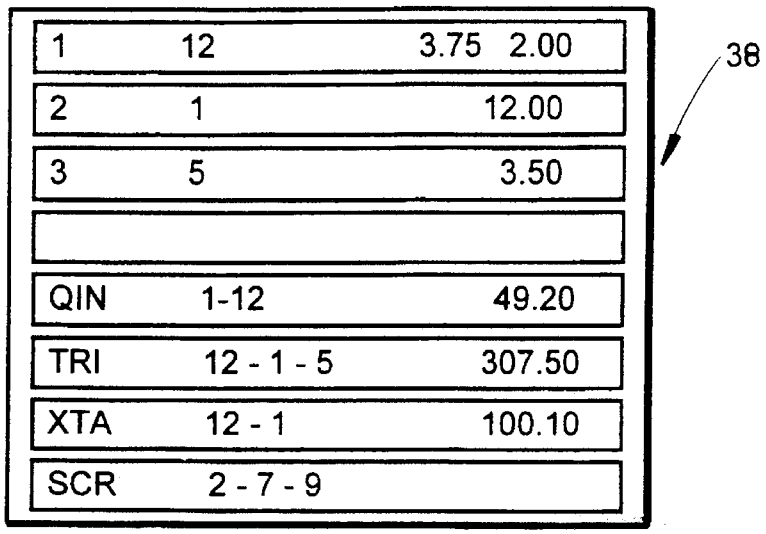
FIG. 7 is an example of the small formals display board of the present invention.

The formals display board can be either the large formals display board 34 as illustrated in FIG. 6 or the small formals display board 38 as illustrated in FIG. 7. The large formals display board 34 as illustrated in FIG. 6 is typically thirty-two characters wide by twelve lines deep with 1.2 inch character blocks and is typically a "DataWall" Display Panel as manufactured by the assignee of the present application. The small formals display board 38 as illustrated in FIG. 7 is typically twenty-four characters wide by eight lines deep with 1.2 inch character blocks and is typically a "DataWall" Display Panel as manufactured by the assignee of the present application. The formals display board 34 or 38 receives data via the CPU 11 and is used to display race results as soon as the results are received by decoder 26. The instantaneous display of the results lets the bettors ("punters") know that the establishment is ready to pay on the winning bets. The difference between the two formals display boards other than size is that the large display 34 (FIG. 6) shows the horses' names in addition to the actual odds paid. The last three lines of the large formals display board 34 can be used for sponsors' advertisements if these lines are not required for the display of race results. These lines may be required, however, if the race result is a "dead-heat" or a tie and more than one winner is displayed. The small formals display board 38 of FIG. 7 has no additional lines for advertising purposes.

Figure 8:
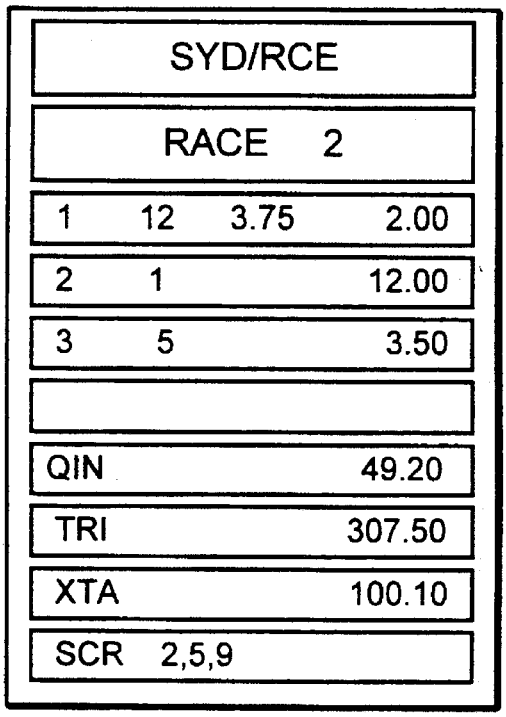
FIG. 8 is an example of the historic results display board of the present invention.

The historic results display board 40 as shown in FIG. 8 includes two top rows of nine characters of 2.1 inches each and eight bottom rows of sixteen characters of 1.2 inches. While this is a custom display board, it is typically a "MenuWall" Display Panel as manufactured by the assignee of the present application. The "MenuWall" Display Panel stores data in pages and displays one result per page starting with the first race then in turn all other races until all the results have been displayed and the cycle starts again.

Figure 9:
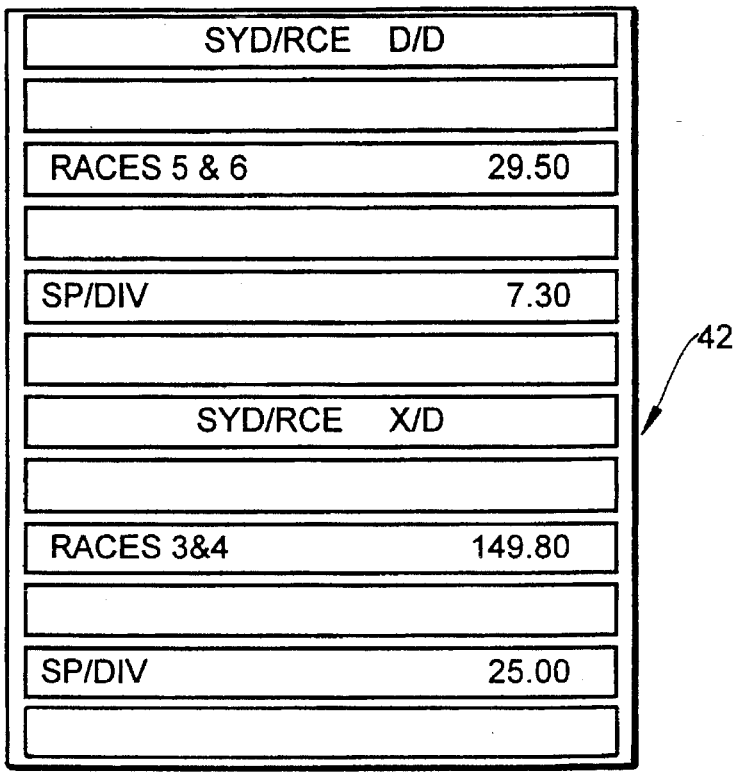
FIG. 9 is an example of the doubles display board of the present invention.

The doubles display board 42 as shown in FIG. 9 includes twelve lines of sixteen characters of 1.2 inches each and is typically another "MenuWall" Display Panel as manufactured by the assignee of the present application. The doubles display board is used to display the "Daily" and "Extra Doubles" for each meeting being run and includes sufficient space to display other information, if necessary, as received via decoder 26.

Figure 10:
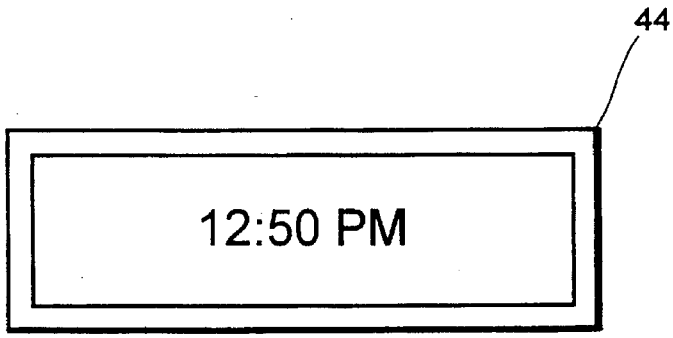
FIG. 10 is an example of the clock display board of the present invention.

The clock display board 44 as shown in FIG. 10 is a time piece in the form of a 60 column display, typically an "InfoDataWall" Display Panel as manufactured by the assignee of the present application. The time is regularly updated by CPU 11, but, as a security measure, the time is ultimately controlled by the data stream received-via decoder 26 wherein a time stamp is included with each message.

As shown in FIG. 1, the header display board 28, the horses display board 30, the jockeys/odds display board 32, the formals display board 34 or 38 and the clock display board 44 (the first four of which are "DataWalls" and the fifth of which is treated as a "DataWall") communicate with the CPU 11 via the first RS232 serial port 50 at 9600 Baud, typically with 8 data bits, 2 stop bits and no parity. Similarly, the historic results display board 40 and the doubles display board 42 (both of which are "MenuWalls") communicate with the CPU 11 via the second RS232 serial port 51 at 2400 Baud with 13 pages, typically with 8 data bits, 2 stop bits and no parity.

Figure 11:
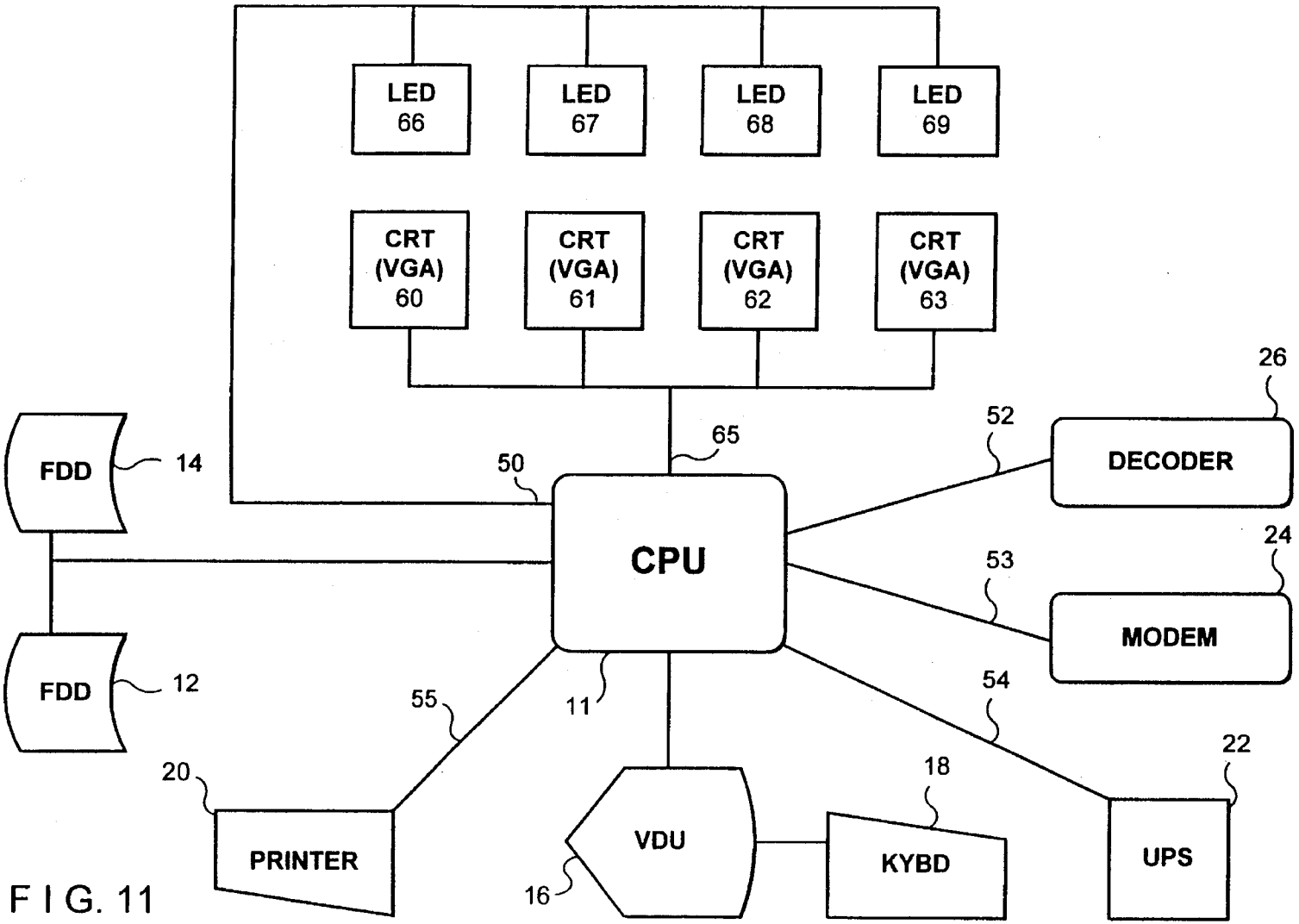
FIG. 11 is a schematic of an alternative embodiment using CRT screens in place of LED matrix displays.

Alternately, as shown in FIG. 11, particularly for off-site betting parlor applications, the integrated display system may substitute CRT displays 60, 61, 62, 63 for the various LED displays 28, 30, 32, 34 (or 38), 40, 42 and 44. Due to the large amount of data to be displayed and the requirement for high resolution, twenty-seven inch VGA screens are typically used instead of standard television screens. Typically, one screen is assigned to each racetrack at the off-site betting parlor so that the bettors ("punters") can be informed of the action at several racetracks, with a single line LED display 66, 67, 68 or 69 (driven by CPU 11 via serial port 50) over each screen to label or display the track name associated with the given screen.

The opening of the screen for the upcoming race, the VGA data screens will display:

Subheader information:
- TAB Code
- Race Number
- Race Track
- Due Start Time
- Track & Weather Conditions Main Data Screen information
- Saddle Cloth Number
- Full Horse Name
- Gate Number ("Barrier Draw" in Australian parlance)
- Jockey's Name
- Jockey's Weight At given time spacings, such as 20, 15, 10 and 5 minutes (this example includes four time periods rather than the three time periods for the LED based display), prior to the race, the jockeys' names and weights are replaced with odds (i.e., "TAB approximate dividends" in Australian parlance). There are typically four columns of Win odds ("approximates") and one column of place odds ("approximates"). In this configuration, the CPU 11 is fitted with a six stack video driver board 65, which allows upgrading from four racetrack system displays to six racetrack system displays without computer hardware upgrades. The software of CPU 11 allows complete automated operation with minimal clerk intervention throughout both day and night events.

In off-site operation, modem 24 and/or decoder 26 receives frequent and periodic parimutuel data from a central source. In on-site operation, data is typically directly transmitted to CPU 11. This data is organized by the CPU 11 and broadcast to the various display boards or CRT screens 60, 61, 62, 63. Importantly, the frequent changes of the various odds due to the parimutuel system is transmitted to the jockeys/odds board 32 as described hereinabove for display.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. An apparatus comprising:

means for receiving a parimutuel data stream derived from a succession of racing events;

means for selecting selected portions of the parimutuel data stream; and a display means in communication with said means for selecting, said displays means including at least first, second and third alphanumeric displays for each of a plurality of bets, said first, second and third alphanumeric display corresponding to a first, second and third sequential time intervals prior to a racing event, respectively, wherein said first sequential time interval ends prior to said second sequential time interval, said second sequential time interval ends prior to said third sequential time interval and said third sequential time interval ends prior to start of the racing event;

said display means displaying said selected portions of the parimutuel data stream from said means for selecting:

a. during said first sequential time interval, said first alphanumeric displays display fluctuating updated parimutuel data as received from said means for selecting selected portions of the parimutuel data stream;

b. at times subsequent to said first sequential time interval, said first alphanumeric displays display constant parimutuel data as received from said means for selecting selected portions of the parimutuel data stream at a time equal to an end of said first sequential time interval;

c. during said second sequential time interval, said second alphanumeric displays display fluctuating updated parimutuel data as received from said means for selecting selected portions of the parimutuel data stream;

d. at times subsequent to said second sequential time interval, said second alphanumeric displays display constant parimutuel data as received from said means for selecting selected portions of the parimutuel data stream at a time equal to an end of said second sequential time interval;

e. during said third sequential time interval, said third alphanumeric displays display fluctuating updated parimutuel data as received from said means for selecting selected portions of the parimutuel data stream.

2. The apparatus of claim 1 wherein said display means comprises a plurality of light-emitting-diode arrays.

3. The apparatus of claim 1 wherein said display means is at least one CRT display.

4. The apparatus of claim 1 wherein said means for receiving a parimutuel data stream includes a modem.

5. The apparatus of claim 1 wherein said means for receiving a parimutuel data stream includes a decoder receiving television signals.

6. The apparatus of claim 1 wherein said means for receiving a parimutuel data stream includes a decoder receiving a sideband of a television signal.

7. The apparatus of claim 2 wherein said display means includes a first light-emitting-diode array for displaying jockeys' names and weights prior to said first time period in place of said display portions.

8. The apparatus of claim 7 wherein said display means further includes a second light-emitting-diode array for displaying results of a most recent race.

9. The apparatus of claim 8 wherein said display means further includes a third light-emitting-diode array for displaying results of a plurality of recent races.

10. The apparatus of claim 9 wherein said display means further includes a fourth light-emitting-diode array for displaying supplementary betting information.

11. The apparatus of claim 10 wherein said display means further includes a fifth light-emitting-diode array for displaying a plurality of data chosen from a group including race code, track location, weather, track rating, track distance, race number, and current race start time.

12. The apparatus of claim 11 wherein said display means further includes a sixth light-emitting-diode array for displaying a plurality of data for each race participant chosen from a group including saddle cloth number, name and gate number.

13. The apparatus of claim 12 wherein said display means further includes a seventh light-emitting-diode array for displaying the time.

14. The apparatus of claim 13 wherein the time displayed on said seventh light-emitting-diode array is controlled by the parimutuel data stream wherein a time stamp is included in each message in said parimutuel data stream.

* * * * *